United States Patent [19]

Jensen et al.

[11] Patent Number: 4,629,057

[45] Date of Patent: Dec. 16, 1986

[54] DISTRIBUTING DEVICE

[75] Inventors: Clemens J. Jensen, Dallas; Wyman R. Westmoreland, Irving, both of Tex.

[73] Assignee: Princeton Packaging, Inc., Dallas, Tex.

[21] Appl. No.: 668,865

[22] Filed: Nov. 6, 1984

[51] Int. Cl.[4] ..... B65G 47/34

[52] U.S. Cl. ..... 198/424; 198/431; 198/468.9; 53/244

[58] Field of Search ..... 198/424, 427, 429, 431, 198/436, 485, 750, 751, 752, 858, 346.2, 468.01, 468.9; 414/48; 53/244, 246, 248, 505; 221/68, 246

[56] References Cited

U.S. PATENT DOCUMENTS

| | | | |
|---|---|---|---|
| Re. 31,834 | 2/1985 | Manetta | 198/751 |
| 3,324,987 | 6/1967 | Kiesser | 198/424 X |
| 3,587,827 | 6/1971 | Schoen | 198/750 X |
| 3,641,735 | 2/1972 | Daily et al. | 414/48 X |
| 3,920,134 | 11/1975 | Scarpa et al. | 198/429 X |
| 4,172,480 | 10/1979 | Ellis | 198/427 X |

*Primary Examiner*—Joseph E. Valenza
*Assistant Examiner*—Lyle Kim

[57] ABSTRACT

A distributing device for placing cakes of meat into trays comprising a frame, a carriage mounted on the frame for reciprocating movement therealong between a home position where meat cakes are received to a meat drop position where the meat cakes are dropped into trays, and a pair of trap doors mounted on the carriage for reciprocating movement therealong in opposite directions and arranged to receive meat cakes. A drive device is connected to the carriage for movement of the carriage relative to the frame, while another drive device is connected to the doors for movement of the doors relative to the carriage. Provisions are made for successively moving the carriage with its load of meat cakes from its home position to its meat drop position where the trap doors are aligned with a row of trays, opening the trap doors to drop the meat cakes into a corresponding number of trays, closing the trap doors and returning the carriage to its home position.

10 Claims, 8 Drawing Figures

DISTRIBUTING DEVICE

BACKGROUND OF THE INVENTION

This invention relates to a system for filling meat trays and, more particularly, to a distributing device for automatically placing cakes of meat into trays.

Normal practice has been to manually place meat cakes into trays, followed by sealing of the trays. This is a time-consuming and expensive operation. To the best of our knowledge, there is no device for automatically loading trays with meat cakes.

SUMMARY OF THE INVENTION

In accordance with the invention, a distributing device is provided for automatically placing cakes of meat into a set of trays arranged in rows. The device comprises a frame, a carriage mounted on the frame for reciprocating movement therealong between a home position where meat cakes are received to a meat drop position where the meat cakes are dropped into the trays, and a pair of trap doors mounted on the carriage for reciprocating movement therealong in opposite directions and arranged to receive a row of meat cakes. A drive device is connected to the carriage for reciprocating movement of the carriage relative to the frame, while another drive device is connected to the trap doors for reciprocating movement of the doors relative to the carriage. Provisions are made for successively supplying a row of meat cakes to the doors while the carriage is in its home position and the doors are closed, moving the carriage to a meat drop position where the doors are aligned with a first row of the set of trays, opening the doors to drop the meat cakes into a corresponding number of trays of the first row, and closing the doors and returning the carriage to its home position. This constitutes one cycle of the carriage. This cycle is repeated for filling each of the remaining rows of the set of trays, at which time a new set of trays is supplied to the distributing device for filling.

DESCRIPTION OF THE PREFERRED EMBODIMENT

Figure 1:
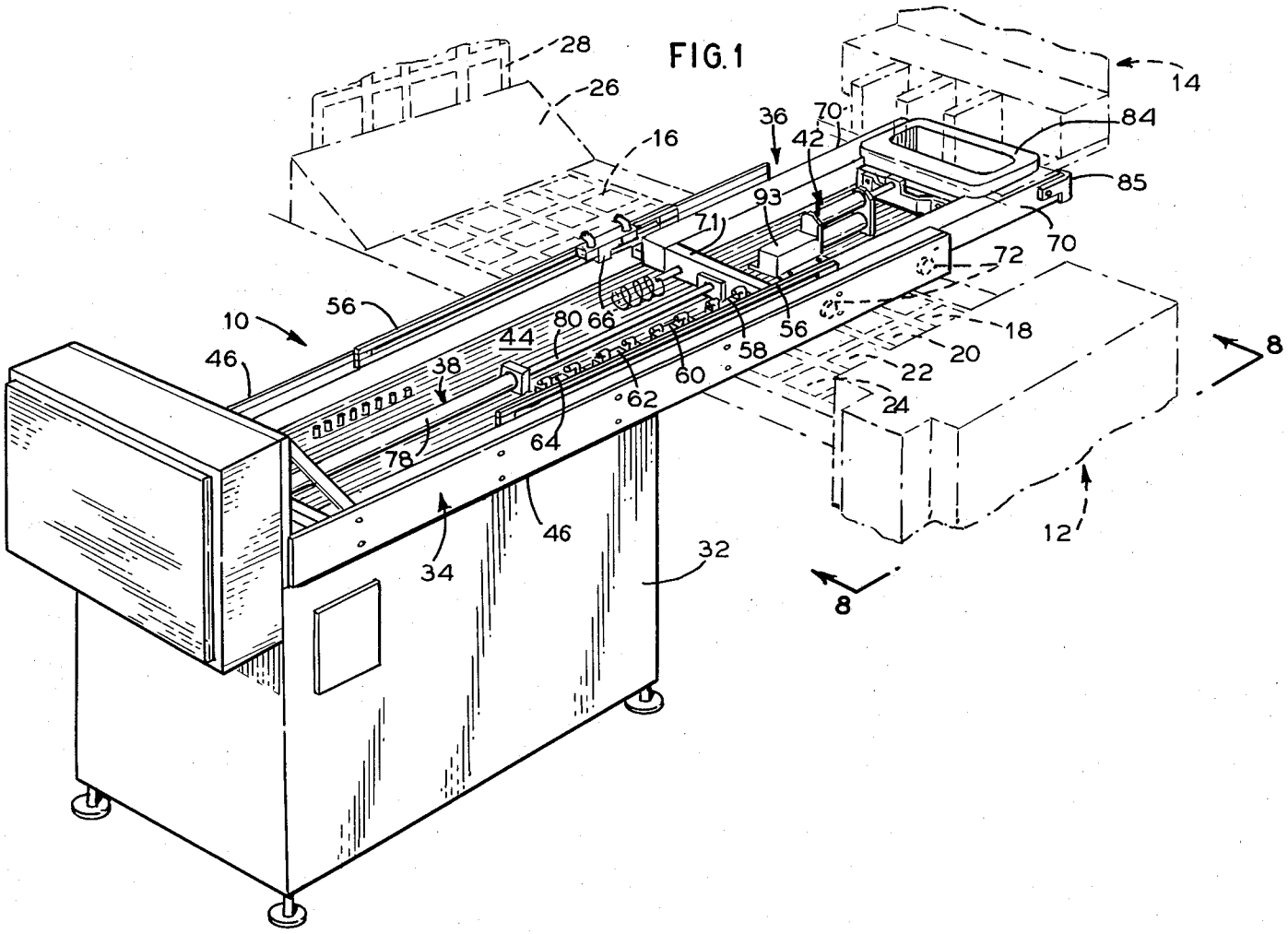
FIG. 1 is a perspective view of the distributing device of the invention in its home position, with a meat cake forming device and a tray forming device shown in phantom lines.
Figure 2:
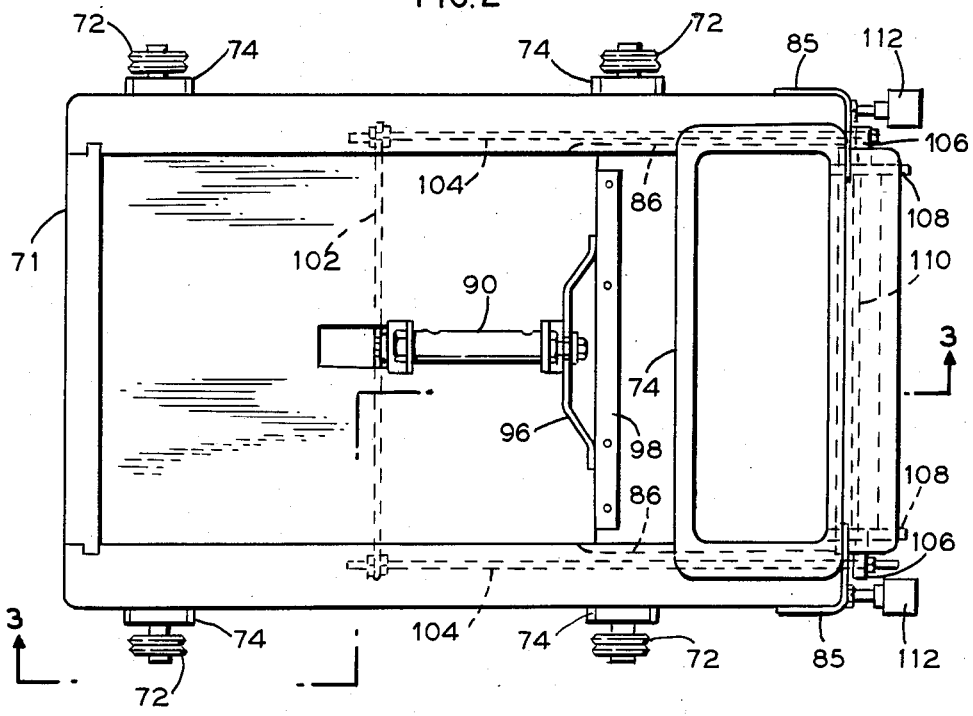
FIG. 2 is a plan view of the carriage of the distributing device.
Figure 3:
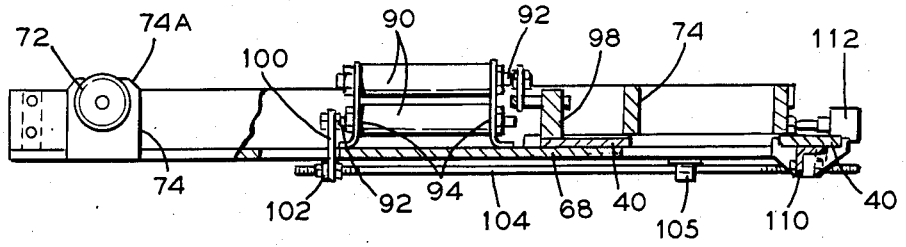
FIG. 3 is a sectional view taken along the line 3—3 of FIG. 2.

FIG. 1 shows a meat indexer or distributor 10, a tray forming device 12 and a meat cake forming device 14.

Device 14 converts blocks of ground meat into rectangular compressed meat cakes or patties 15 and deposits them onto the closed trap doors, later to be described, of the meat distributor 10. Device 14 is a standard FORMAX, Inc. industrial meat processor known as FORMAX 26.

Figure 7:
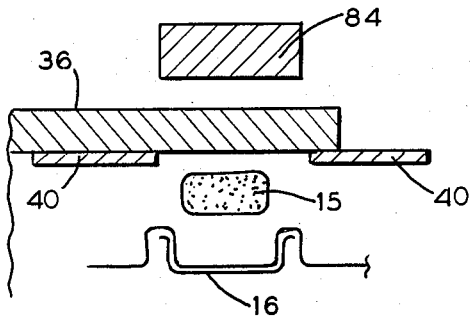
FIG. 7 is a schematic sectional view taken along line 7—7 of FIG. 6.

Device 12 produces thermoformed plastic trays 16 from barrier film and conveys them in four parallel contiguous rows 18, 20, 22 and 24 to meat indexer 10 for receiving the meat cakes, with the trays having adjacent edges joined to each other, as shown in FIG. 7. Next, the trays are conveyed to a chamber 26 where air is evacuated from the trays and replaced with a gas which inhibits bacterial growth to provide longer shelf life and retention of flavor and color, followed by closing of the top of the trays by heat sealing a high barrier film 28 onto each tray. Then the trays are separated. Device 12 is a standard Kramer - Grebe industrial machine known as TIROMAT VA560.

Device 14 and distributor 10 are arranged end to end for delivery of meat cakes by device 14 to distributor 10, while device 12 extends perpendicular to and crosses under distributor 10.

Distributor 10 is supported on a base 30 by suitable framing 32 and comprises a rectangular frame 34, a carriage 36 mounted on the frame for reciprocating movement therealong, a hydraulic drive device 38 connected to one end of the carriage, a pair of trap doors 40 mounted on the carriage, and a pneumatic drive device 42 connected to the trap doors for closing and opening of the doors.

With reference to FIGS. 1, 2, 3 and 5, frame 34 includes bottom member 44 and side members 46. Each side member 46 is U-shaped and comprises a vertical member 48 and horizontal members 50 and 52 respectively extending from the upper and lower ends of member 48. The top of the free end of member 52 is provided with a track 54 extending along the length of member 52 for support of carriage 36, while a switch support plate 56 is secured to and extends along the length of the free end of member 50. Limit switches 58, 60, 62 and 64 are mounted on plate 56 of one of the side members 46 at spaced positions along the length of plate 56, while a reset switch 66 is secured to plate 56 of the other side member.

Carriage 36 is of rectangular shape and is formed by a bottom member 68, side members 70 and a rear cross member 71 connected to one end of each side member 70, with a pair of spaced guide wheels 72 secured by mounting blocks 74 to each side member 70 and arranged to engage track 54 on the corresponding side member 46 to provide longitudinal movement of carriage 36 relative to frame 34. The mounting block 74 for the rear guide wheels 72 of each side member 70 is formed with a cammed upper surface **74*a* to trip the limit and reset switches upon movement of the carriage. Hydraulic drive device 38 includes a cylinder 78 secured to bottom member 44 and a piston 80 arranged to slide within cylinder 78 and having one end connected to the outside of cross member 72** at the midpoint thereof.

Figure 6:
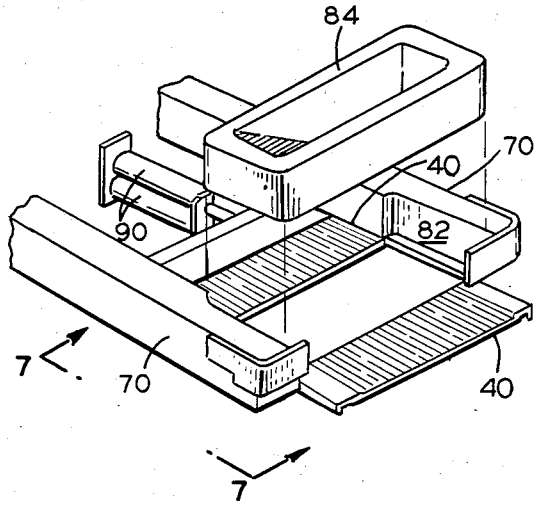
FIG. 6 is a partial perspective view similar to FIG. 4 except that the distributing device is rotated 90° to show the trap doors in their open position.
Figure 5:
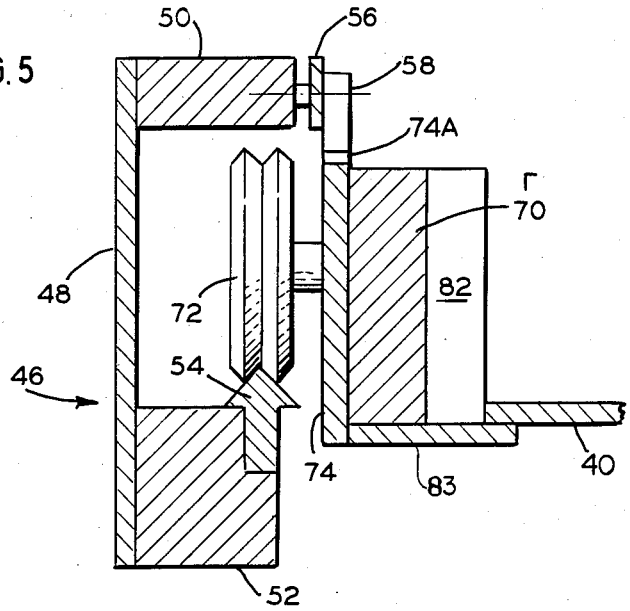
FIG. 5 is an enlarged sectional view taken along the line 5—5 of FIG. 4.

The inside of the front portion of each side member 70 is formed with a recess 82 to accommodate and support an annular mold block 84 disposed superjacent trap doors 40. FIG. 6 shows the mold block removed for clarity. An angle plate 85 is secured to each side member 70 with one of its legs extending along the outer side face of member 70 and the other leg extending along and slightly beyond the front face of member 70 to hold block 84 in place. Block 84 guides meat patties from device 14 onto the trap doors and cooperates with the doors to expel the patties into the trays. A plate 83 is secured to and extends along the length of the bottom of each side member 70 and projects beyond the inside face of the corresponding side member to provide a lip 86 for support of doors 40. On opening, the doors slide in opposite directions along support lips 86. Pneumatic drive device 42 simultaneously opens and closes doors 40 and includes a pair of cylinders 90 and corresponding pistons 92. As shown in FIG. 1, lower piston 92 is protected by a cover 93 secured to member 68. Cylinders 90 are parallel and disposed one above the other, extend longitudinally of carriage 36 at its midpoint, and have their opposite ends supported by a pair of brackets 94 which are fastened to bottom member 68. Upper piston 92 has one end connected by a bracket 96 to an upright mounting block 98 secured to one end of rear trap door 40 and extending along the width thereof. Lower piston 92 has one end connected to a bracket 100 which extends through an opening in bottom member 68 for connection to a bracket 102 which extends across and beneath bottom member 68, and has its opposite ends connected to tie rods 104 extending longitudinally of and through bearing blocks 105 on bottom member 68 and secured to brackets 106 disposed at opposite ends of and below front trap door 40. Brackets 106 are connected to brackets 108 which are formed with recesses in which the door is positioned. Further support of the door is provided by an angle bar 110 having one leg secured to the bottom of the door and the opposite ends of its other leg secured to brackets 108. The front end of each side member 70 is provided with a bumper 112 which halt forward movement of carriage 36 when the bumpers contact device 14 and maintain a fixed relation between device 14 and carriage 36 when the carriage is in its home position.

Operation of carriage 36 and its doors 40 is controlled by the limit and reset switches which are part of a conventional pneumatic logic controlled system. Reset switch 66 is positioned directly opposite cross member 71 of the carriage when the carriage is in its home position. Limit switches 58, 60, 62 and 64 are so spaced along plate 56 that upon being tripped by cam block 74, thereby stopping carriage 36, trap doors 40 are centrally located relative to trays 16 of rows 18, 20, 22 and 24, respectively. Further, device 14 is so constructed and arranged that three, three-pound rectangular and compressed meat cakes are deposited through block 74 onto trap doors 40 at spaced positions that are aligned with the openings of a corresponding number of trays 40 in each of rows 18, 20, 22 and 24 when the carriage is stopped by limit switches 58, 60, 62 and 64, respectively.

Figure 4:
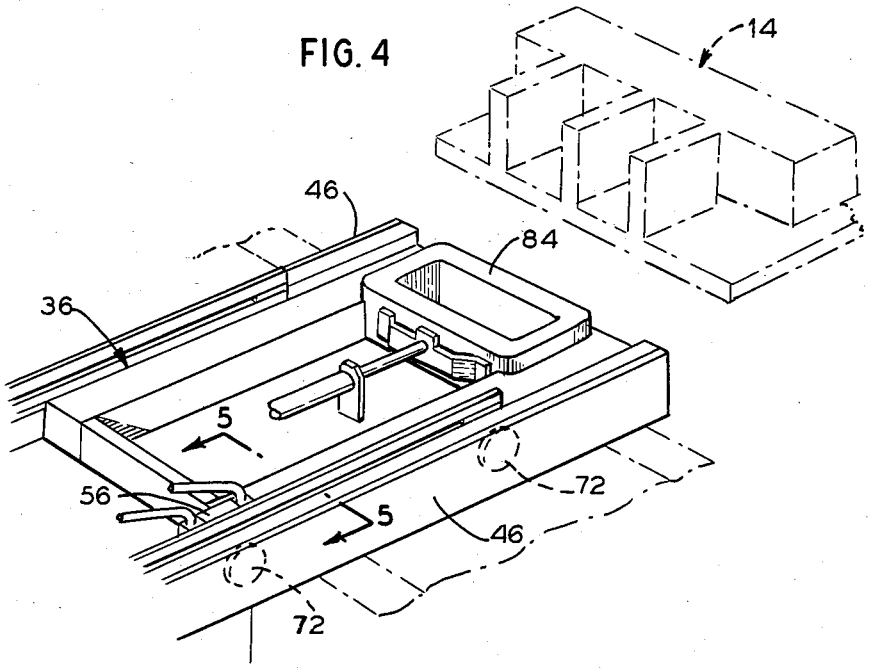
FIG. 4 is a partial perspective view of the distributing device in its first meat drop position.
Figure 8:
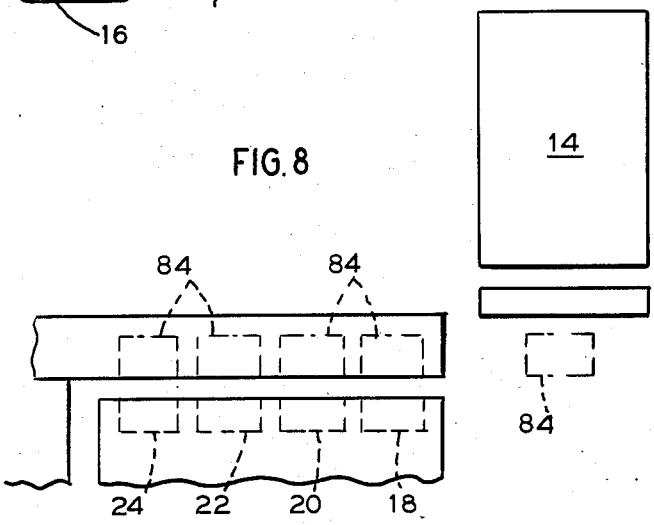
FIG. 8 is a schematic sectional view taken along line 8—8 of FIG. 1.

With reference to FIGS. 1, 4 and 6, in operation of the equipment described, carriage 36 is considered in its home position when bumpers 112 of carriage 36 are in contact with meat device 14 and trap doors 40 are closed, in which case the opposed edges of the doors are about 5/16" apart. Then device 14 drops meat cakes onto trap doors 40 and conveys a signal to the control system of device 10 to start its cycle, whereupon piston 80 moves into cylinder 78 to move carriage 36 until cam block 74 trips limit switch 58 to stop the carriage at a position where its doors 40 are located over three trays of tray row 18, as shown in FIGS. 4 and 6. Then the pneumatic logic system successively commands pistons 92 to move into their cylinders 90 to open doors 40 to drop meat cakes into trays 16; pistons 92 to move out of their cylinders to close doors 40; and piston 80 to move out of cylinder 78 to move carriage 36 back to its home position. This cycle continues until the trays of rows 20, 22 and 24 are filled by successively activating limit switches 60, 62 and 64. This sequence of events is schematically shown in FIGS. 7 and 8. When the carriage returns to its home position after tripping limit switch 64, reset switch 66 is activated to produce a signal directed to device 12 to advance another set of 12 trays to distributor 10 for filling.

We claim:

1. A distributing device for placing cakes of meat into trays comprising:

a frame, a carriage mounted on the frame for reciprocating movement therealong between a home position where a row of meat cakes is received to a meat drop position where the row of meat cakes is dropped into a corresponding row of trays, a trap door device mounted on the carriage for reciprocating movement therealong and arranged to receive the row of meat cakes in the home position and support the row of meat cakes while the carriage is transporting the row of meat cakes to the drop position, a drive device connected to the carriage for reciprocating movement of the carriage relative to the frame to transport the carriage and the trap door device between the home and the drop positions, and a drive device carried by the carriage and connected to the trap door device for imparting reciprocating movement to the trap door device relative to the carriage.

2. A distributing device as recited in claim 1, further comprising:

means for successively supplying rows of meat cakes to the trap door device while the carriage is in its home position and the trap door device is closed, moving the carriage to the meat drop position where the trap door device is aligned with the row of trays, opening the trap door device to drop the row of meat cakes into the corresponding row of trays, closing the trap door device and returning the carriage to its home position.

3. A distributing device as recited in claim 2, wherein the frame includes a pair of tracks, and the carriage is provided with guide wheels which engage the tracks to provide movement of the carriage relative to the frame.

4. A distributing device as recited in claim 3, wherein the trap door device includes a pair of doors mounted on the carriage for reciprocating movement therealong in opposite directions.

5. A distributing device as recited in claim 4, wherein the drive device for the carriage includes a hydraulic device comprising a cylinder secured to the frame and a piston arranged to slide in the cylinder and having one end connected to the carriage.

6. A distributing device as recited in claim 5 wherein the drive device for the trap door device includes a pneumatic device comprising a pair of cylinders and corresponding pistons, the cylinders being secured to the carriage, each piston having one end connected to one of the trap doors.

7. A distributing device as recited in claim 6 wherein a limit switch is secured to the frame, and a block having a cam surface is secured to the carriage and arranged upon movement of the carriage from its home position to trip the limit switch to stop the carriage at a position where its doors are aligned with the row of trays.

8. A distributing device as set forth in claim 1 in which the trap door device includes a pair of slidable trap doors guided at opposite ends in the carriage for movement toward and away from each other, the drive device carried by the carriage imparting the movement to the trap doors to move them toward and away from each other, and an annular meat cake receiver carried by the carriage above the trap doors for receiving the row of meat cakes spaced therein above the closed trap door and along opposed closed ends thereof, said carriage transporting the annular receiver and trap doors from the home position to the drop position where the trap doors slide open to drop the row of meat cakes into the underneath trays.

9. A distributing device as set forth in claim 8 in which the trap doors extend transversely to the fore-and-aft movement of the carriage and are guided for fore-and-aft movement relative to the carriage and in which the annular receiver extends transversely to the fore-and-aft movement of the carriage accommodating therein the row of meat cakes on the trap doors along the closed ends thereof.

10. A distributing device for placing cakes of meat into a set of trays arranged in first and second rows comprising:

a frame, a carriage mounted on the frame for reciprocating movement therealong between a home position where a row of meat cakes is received to a meat drop position where the row of meat cakes is dropped into the trays, a pair of trap doors mounted on the carriage for reciprocating movement therealong in opposite directions and arranged to receive the row of meat cakes in the home position and support the row of meat cakes while the carriage is transporting the row of meat cakes to the drop position, a drive device connected to the carriage for reciprocating movement of the carriage relative to the frame to transport the carriage and the trap doors between home and drop positions, a drive device carried by the carriage and connected to the trap doors for imparting reciprocating movement to the doors relative to the carriage, and means for successively supplying the row of meat cakes to the doors while the carriage is in its home position and the doors are closed, moving the carriage to a meat drop position where the doors are aligned with the first row of trays, opening the doors to drop the row of meat cakes into the first row of trays, closing the doors and returning the carriage to its home position, supplying another row of meat cakes to the doors, moving the carriage to a meat drop position where the doors are aligned with the second row of trays, opening the doors to drop the row of meat cakes into the second row of trays, and closing the doors and returning the carriage to its home position.

* * * * *